United States Patent [19]

Poche

[11] 4,193,217

[45] Mar. 18, 1980

[54] PIVOTABLE BUCKET WITH A ROTATABLE EARTH MOVING MECHANISM

[76] Inventor: John M. Poche, 6317 Franklin Ave., New Orleans, La. 70122

[21] Appl. No.: 837,846

[22] Filed: Sep. 29, 1977

[51] Int. Cl.[2] ..... E02F 3/24

[52] U.S. Cl. ..... 37/93; 37/43 B; 37/189

[58] Field of Search ..... 37/93, 92, 91, 189, 37/190, 43 A, 43 B, 2 R, 103; 214/138 C, 768

[56] References Cited

U.S. PATENT DOCUMENTS

| | | | |
|---|---|---|---|
| 738,597 | 9/1903 | Berglund | 37/92 |
| 1,114,505 | 10/1914 | Moore | 37/2 R |
| 2,136,982 | 11/1938 | Pratt | 37/98 X |
| 2,171,056 | 8/1939 | Clay | 37/43 B |
| 2,518,622 | 8/1950 | Ingersoll | 37/43 B |
| 2,605,561 | 8/1952 | Maynard et al. | 37/43 B |
| 3,298,547 | 1/1967 | Williams | 37/103 X |
| 3,757,439 | 9/1973 | Khaitovitch | 37/190 X |
| 3,787,989 | 1/1974 | Heckathorn | 37/90 |
| 3,916,543 | 11/1975 | Poche | 37/93 |
| 3,993,206 | 11/1976 | Jomen et al. | 37/103 X |

*Primary Examiner*—Clifford D. Crowder
*Attorney, Agent, or Firm*—Morris Sussman

[57] ABSTRACT

A pivotable bucket comprising a built-in housing containing a rotatable earth moving mechanism secured to an elbow-type power boom of an excavator or vehicle having hydraulic power thereon. The earth moving mechanism is adapted to dig earth both in a horizontal and lateral direction and to force the diggings out of the upper side of the bucket in a continuous controlled flow. The earth moving mechanism is activated by the power plant of a carrier vehicle.

9 Claims, 15 Drawing Figures

PIVOTABLE BUCKET WITH A ROTATABLE EARTH MOVING MECHANISM

This invention relates to earth moving machinery adapted to general excavation, ditching, pipe lines, etc.

This application constitutes an improvement over application Ser. No. 491,378 filed on July 24, 1974 and issued as U.S. Pat. No. 3,916,543 on Nov. 4, 1975.

The invention of this application consists in three improvements over that of the parent application, namely;

(1) The pivotable bucket is adapted for horizontal and/or lateral movement. Lateral movement of the travel car is for the purpose of moving the excavator from one side of the carrier to the other. This enables the operator to dig a much wider ditch without having to move the machine from its fixed position. In the parent application the bucket operates only in a horizontal direction.

(2) The ejection blade is now combined with a retaining support ring which serves to confine the diggings within an enclosed space and thus provide for a greater centrifugal force for ejecting the diggings.

(3) A shredder blade wheel and a saw tooth blade mounted thereon which may be substituted for the original shredder for greater effectiveness in uprooting undergrowth such as heavy roots and other heavy obstructions.

The principal object of this invention is to provide a pivotable bucket, having rotatable and laterally moving earth moving mechanism with a continuous flow of dug up earth to a predetermined location.

Another object of the invention is to provide a bucket connected to an elbow-type power boom secured to an excavator.

Another object of this invention is to provide a bucket operated by a hydraulic system or a system using air or other mechanical means.

Another object of this invention is to provide a bucket for work such as ditching, mosquito control, reclamation work, putting out forest fires, making fire lanes and the like.

Another object of this invention is to provide a bucket having rotatable earth moving structure, of any shape and size attachable to an excavator, bulldozer or a front end loader to provide a continuous flow of earth or other material dug up either from a horizontal and/or a lateral direction.

Other and further objects and advantages of this invention may be obvious to one skilled in the art from a reading of this specification and the appended claims and the accompanying drawings examined in connection therewith.

In the drawings.

In several views of this invention, like parts of the invention are indicated by like reference numerals. The reference numeral (10) indicates this invention in its entirety. Reference number (40) indicates the lateral travel mechanism in its entirety.

Figure 2:
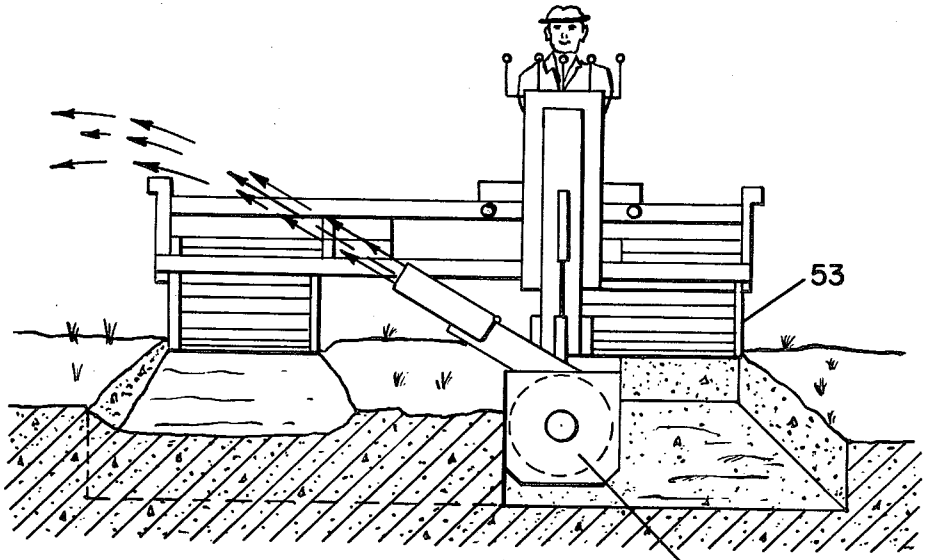
FIG. 2 is a pictorial view of the bucket in operation.
Figure 1:
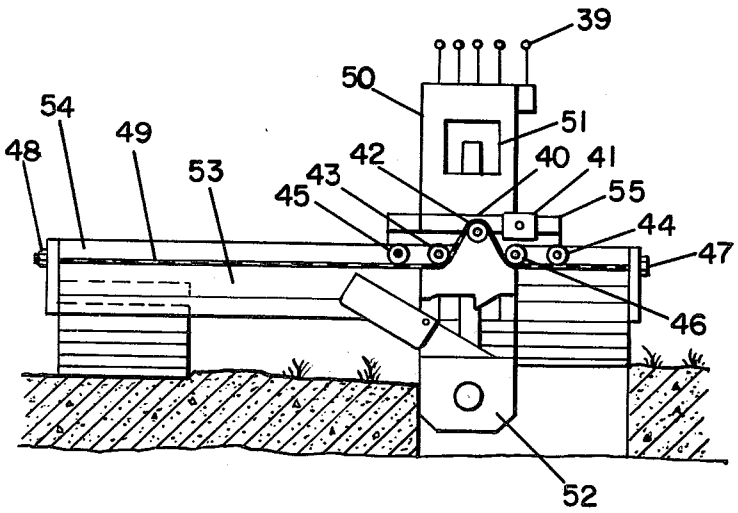
FIG. 1 is a side view of the control means for lateral movement of the pivotable bucket.

Looking first at FIG. 1 of the accompanying drawings, it will be seen that a hydraulic control levers (39) which controls the lateral travel mechanism (40) having a variable speed control motor (41) and idlers (42) and (43) for the travel mechanism with hook rollers (44) on each side of the travel car, hook rollers (45) on each side of the lateral travel mechanism and lateral travel sprocket (46) which controls the motions to the right and left and lateral travel chain take up bolt (47) on one side and lateral travel chain take up bolt (48) on the other side with a lateral travel chain (49). The travel console (50) houses the excavator (51) which is connected to the rotary bucket (52). The amphibious carrier (53) and trolley rails (54) are bolted together and carries excavator travel car (55). The amphibious carrier carries the travel car and the trolley rails.

Figure 7:
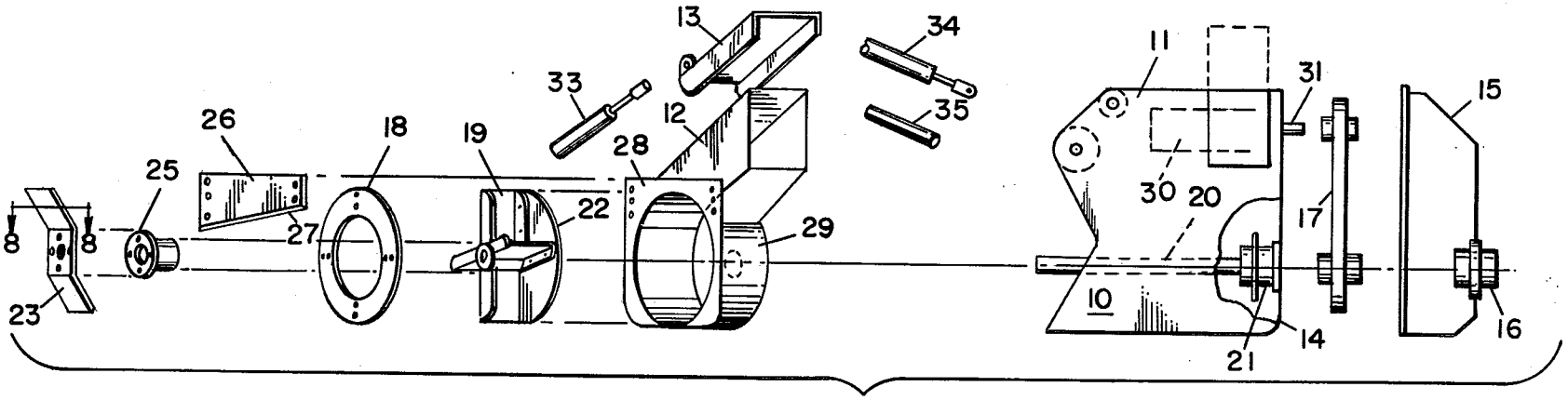
FIG. 7 is a pictorial exploded view of this invention.
Figure 13:
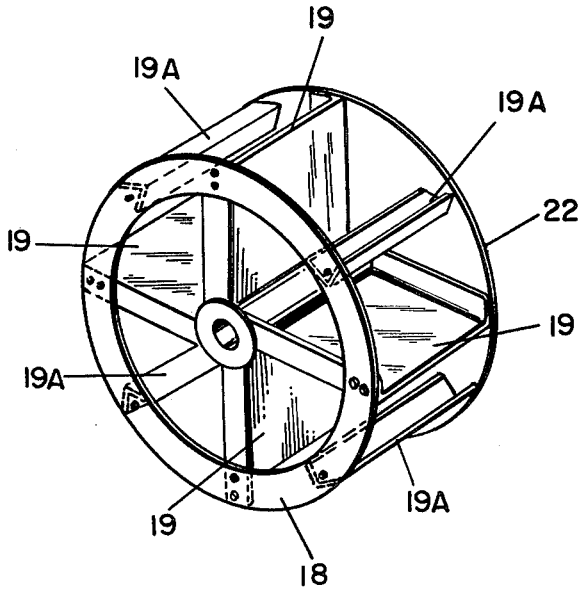
FIG. 13 is a side view of the retaining support ring attached to the internal ejection blade and supporting wheel structure.
Figure 14:
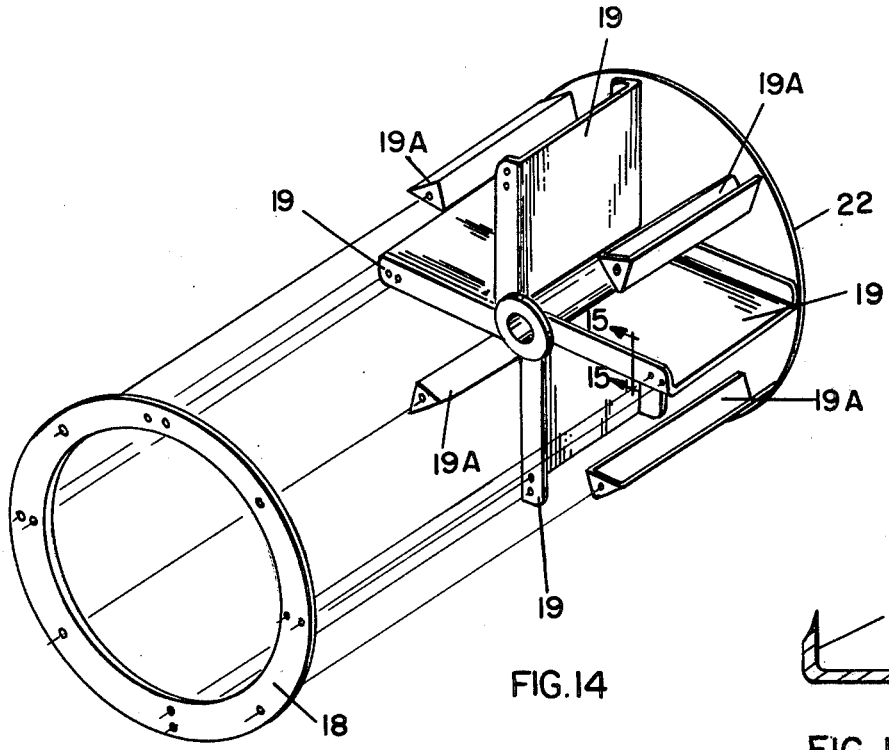
FIG. 14 is an exploded view of the construction shown in FIG. 13 in position for assembly.

Looking at FIG. 7 of the accompanying drawings reference numeral (12) identifies the discharge chute of the pivotable bucket not shown. A controlled deflector (13) is positioned on the chute (12) and a rotary housing (29) shown with face (28) and hydraulic motor (30) receives the rotating wheel structure (22) with the ejection blade (19) which has angular support vanes (19*a*) as shown in FIGS. 13 and 14. The retaining support ring (18) is securable to the ejection blades (19). A combination shear blade and compression plate (26) with a sharp lower edge (27) is bolted onto the face (28) of the housing (29). The bucket (11) is provided with a back wall (14) to which is bolted a reduction drive case (15) for the support of the shaft bearing (16) and the encasement of reduction drive (17). A horizontally disposed shaft (20) is supported by shaft bearings (16) and shaft (20) is further supported by the forward support bearing (21).

Figure 15:
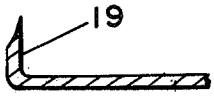
FIG. 15 shows one of the ejection blades with a tapered cutting edge taken substantially along line 15—15 of FIG. 14.

An additional improvement over U.S. Pat. No. 3,916,543 involves the retaining support ring (18) as shown in FIG. 7 of the present drawing. Ring (18) is bolted to the outer ends of ejection blade (19). A prime purpose of the ring (18) is to support the outer corner of the blade and the forward edges of blade (19) is sharpened as shown in FIG. 15. The rotary housing (29) confines the solid and/or liquid materials dug up by the bucket and the confined space serves to cause a pressure build up and thus forcibly eject said dug up materials from said confined area. Furthermore the leading edge of the ejection blade (19) is sharp and in combination with the shear blades (26) and sharp lower edge (27) are adapted to shear off roots and other growths and obstructions from uprooted vegetation or other solid materials.

Figure 3:
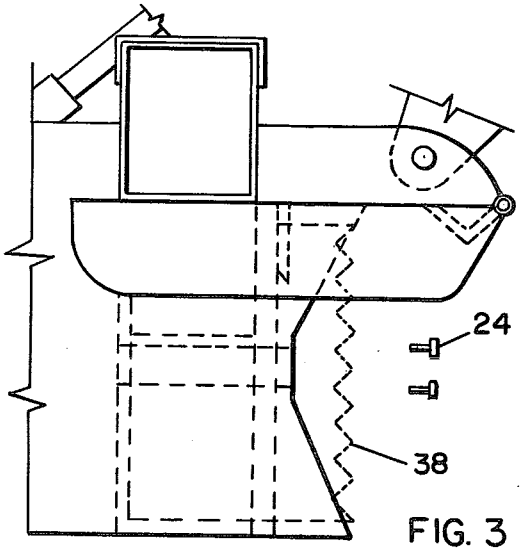
FIG. 3 is a side view of shredder blade wheel and saw tooth blade assembly.
Figure 4:
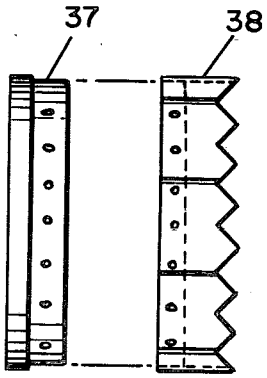
FIG. 4 is a side view of the shredder blade and saw tooth separately.
Figure 5:
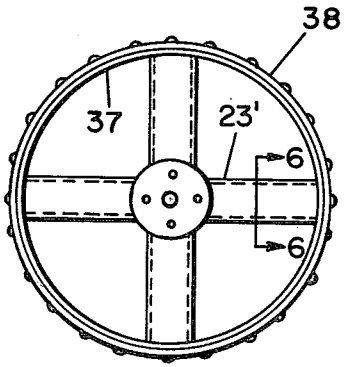
FIG. 5 is a front view of the internal shredder blades.
Figure 6:
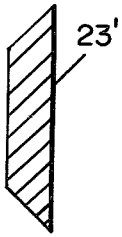
FIG. 6 is a sectional view of tapered ends on the shredder blade (23') taken along line 6—6 of FIG. 5 and viewed in the direction indicated by the arrows.

An added improvement over the patented construction of U.S. Pat. No. 3,916,543 comprises internal shredder blade wheel (37) and saw tooth blade (38) as shown in FIGS. 3-5, which may be substituted for shredder blade (23) by loosening shear bolts (24) from hub (25). Blade (23) has been found satisfactory for use in marshy or watery terrains whereas saw tooth blade (38) may be substituted where heavy rooted undergrowth and other hard to handle materials may be required to be removed.

FIGS. 13 and 14 of the drawing are directed to a further improvement wherein a retaining support ring (18) is bolted to a series of ejection blades (19) with sharpened leading edges and support vanes 19 (*a*) and bolted thereon and secured to a rotating wheel structure (22). The sharp leading edge of the ejection blade in combination with shear blades and compression blade (26) shear off roots and other growths from uprooted vegetation or other difficult to remove growth materials.

Figure 10:
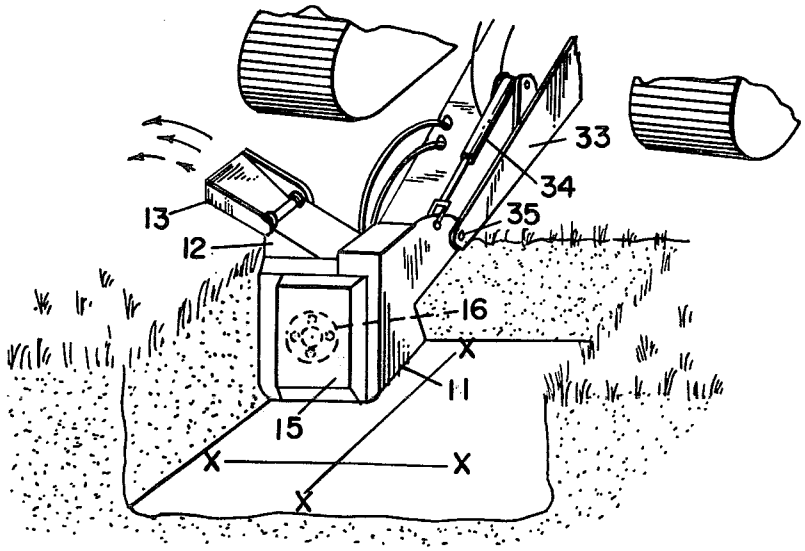
FIG. 10 is a pictorial view of this invention, secured to the boom of a carrier and shown in typical use.
Figure 8:
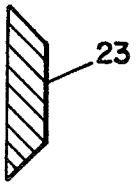
FIG. 8 is a sectional view of the external shredder blade.
Figure 9:
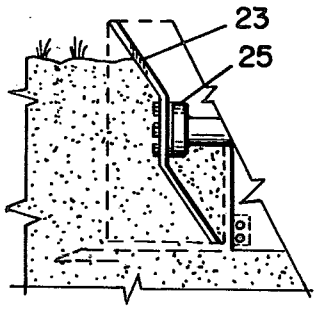
FIG. 9 is a side view of the shredder blade and a portion of its supporting structure, shown cutting into the earth.
Figure 12:
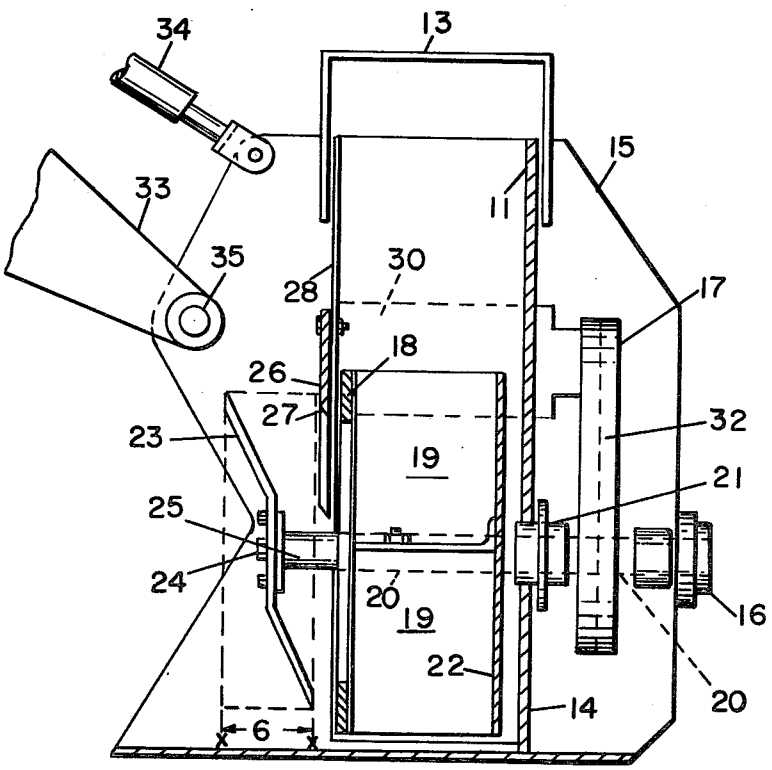
FIG. 12 is a sectional view of this invention, taken substantially along line 12—12 of FIG. 11.
Figure 11:
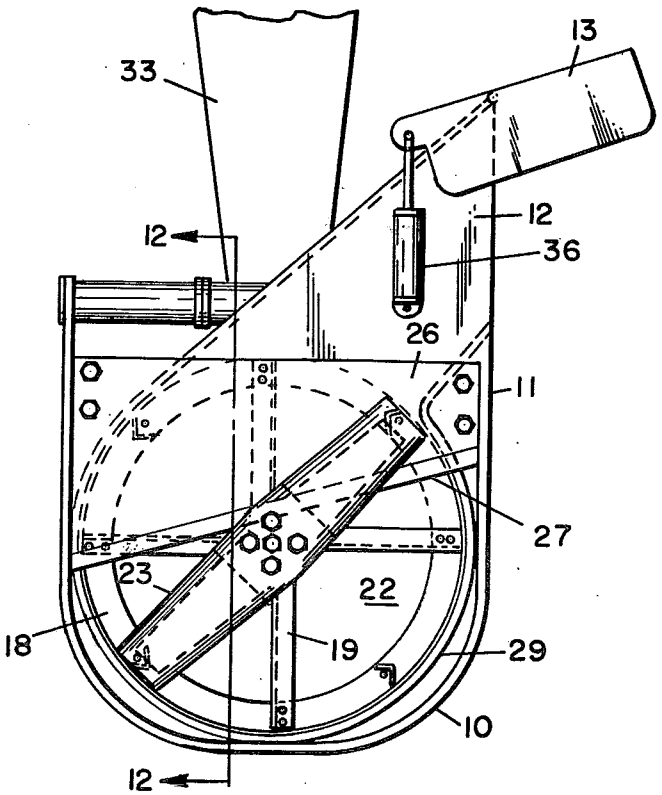
FIG. 11 is a sectional front view of this invention.

The hydraulic motor (30) with its power shaft (31) supports a sprocket over which is placed chain (17) as a means of rotating the rotatable structure of this invention. A power boom (33) as in FIG. 10 of the vehicle to which this invention is attached and a hydraulic cylinder (34) controls the digging angle of bucket (11). The bucket is secured to the power boom (33) by means of a laterally disposed coupling pin (35) whose outer ends project through the upper front sides of bucket (11). The hydraulic cylinder (36) as in FIG. 11 controls the angle of the adjustable deflector (13), the hydraulic cylinder (36) is controlled by the operator of the bucket at his Control Station.

The controlling digging angle of the bucket (11) is done by the operator when in use.

This invention is subject to any and all changes in detail, design, construction, and/or modifications that one may make so long as the changes and/or modifications all fall within the scope and intent of the appended claims.

What I now claim as new and desire to secure by Letters Patent is:

1. A bucket pivotably secured to the outer end of an elbow-type power boom attached to a carrier vehicle having hydraulic power, an earth moving mechanism comprising a rotatable wheel-like structure provided with a plurality of equally spaced and outwardly extending earth ejecting blades integral with said wheel-like structure and being provided additionally with support vanes and a retaining support ring, the wheel-like structure being mounted on a horizontally disposed power shaft having a shredder blade mounted on the outer end of the power shaft and a hydraulic motor mounted in the bucket and connected to the shaft by a reduction drive mechanism and a combination shear blade and compression plate forming a compression chamber in the upper portion of the bucket.

2. The invention of claim 1 wherein the shredder blade has a saw tooth exposed face for improved removal of heavy rooted undergrowth.

3. The invention of claim 1 which includes a control mechanism for lateral movement of the pivotable bucket.

4. The invention of claim 3 wherein the control mechanism includes a control console having a hydraulic control valve, a variable speed control motor and lateral travel trolley rails and lateral travel chains for a lateral travel mechanism.

5. A bucket pivotably secured to the outer end of an elbow type power boom, said boom being mounted on a travel car, said travel car being attached to a carrier vehicle having hydraulic power for lateral movement, said bucket comprising a rotatable earth moving mechanism and a discharge chute having an angularly adjustable deflector at the top side and a control console operated by an operator, and said console includes a hydraulic control valve, a variable speed control motor and lateral travel trolley rails and lateral travel chains for a lateral travel mechanism, said travel car traveling on said travel rails so as to provide the excavator with a travel motion from one side of the vehicle to the other.

6. The invention of claim 5 wherein said rotatable earth moving mechanism includes a wheel-like structure provided with earth ejecting blades and a retaining support ring, the wheel-like structure being mounted on a horizontally disposed power shaft having a shredder blade mounted on the outer end of the power shaft and a hydraulic motor mounted in the bucket and connected to the shaft by a reduction drive mechanism and a combination shear blade and compression plate forming a compression chamber in the upper portion of the bucket.

7. The invention of claim 6 wherein the shredder blade has a saw tooth exposed face for improved removal of heavy rooted undergrowth.

8. The invention of claim 5 wherein said rotatable earth moving mechanism includes a wheel-like structure provided with earth ejector blades and a retaining support ring that bolts to the outer ends of said ejector blades for the prime purpose of supporting the ejector blades.

9. The invention of claim 7 wherein the wheel-like structure provides a centrifugal force and pressure in order to throw out and spread uprooted and other dug up material through the chute.

* * * * *